United States Patent [19]

Gauger

[11] Patent Number: 4,596,176

[45] Date of Patent: Jun. 24, 1986

[54] BRACKET FOR MOUNTING SHELL-LESS DRUMS

[76] Inventor: Gary L. Gauger, 15108 Highland La., Minnetonka, Minn. 55343

[21] Appl. No.: 505,207

[22] Filed: Jun. 17, 1983

[51] Int. Cl.[4] ..... G10G 5/00; G10D 13/02

[52] U.S. Cl. ..... 84/421

[58] Field of Search ..... 84/411 R, 412, 420, 84/421, 419

[56] References Cited

U.S. PATENT DOCUMENTS 3,106,123 10/1963 Johannsen ..... 84/421

4,158,980 6/1979 Gauger ..... 84/421

4,252,047 2/1981 Gauger ..... 84/421

*Primary Examiner*—Benjamin R. Fuller

*Attorney, Agent, or Firm*—Conrad A. Hansen

[57] ABSTRACT

A bracket for mounting shell-less drums such as roto-toms or pre-tuned heads consists of an arcuate member having inwardly directed flanges which have apertures to mount the lugs of the roto-tom or clamps for clamping the pre-tuned head. The bracket is essentially semi-circular and provides its main support at diametrically opposed points of the drum and utilizes additional fastening points for balancing.

2 Claims, 4 Drawing Figures

BRACKET FOR MOUNTING SHELL-LESS DRUMS

BACKGROUND OF THE INVENTION

The mounting and playing of roto-toms has in the past been made somewhat difficult due to the unsatisfactory way in which those drums have been mounted. Typically, roto-toms are mounted by fastening the tuning shaft to a bracket which has typically been less than stable. Also, the mounting hardware available for roto-toms has been such that the stand required is separate and different than those stands used to carry more conventional toms.

The pre-tuned head has provided a direction for producing an inexpensive drum set in view of the fact of the expensive tensioning hardware, and stronger shells are not required. In fact, though, these heads have been marketed and sold with lightweight traditional appearing shell and attaching hooks or with fastening hardware and hooks which fasten to conventional lugs on conventional drum shells. While my previous inventions shown in U.S. Pat. Nos. 4,158,980 and 4,252,049 have proven effective in improving the sound of drums, it was desired to provide a more effective, inexpensive and easily used mounting system for roto-toms and pre-tuned heads.

It is therefore an object of this invention which will allow the mounting of pre-tuned heads and roto-toms to conventional hardware with a minimum of effort and expense and which is suited to being played hard while at the same time obtaining optimum sound quality.

SUMMARY OF THE INVENTION

The instant invention resides in the provision of an arcuate member which is most desirably of a generally semi-circular configuration. The arcuate member has a plurality of flanges depending radially inwardly therefrom. Those flanges have apertures located therein and the arcuate member and flanges are sized so as to mount the flanges to a roto-tom with the lugs of the roto-tom passing through the apertures. In such an arrangement, two end apertures are located at approximately diametrically opposed locations on the arcuate member and serve to support and balance the drum about approximately the center line. One or more flanges and apertures intermediate the diametrically opposed locations serve to steady and balance the drum. Round grommets are provided in the apertures so as to serve to dampen and absorb what little vibration does exist at the lugs of the drum thereby preventing such vibration from being transmitted to the stand to which the drum is mounted.

Drums such as roto-drums or pre-tuned heads generally have vibrating portions and non-vibrating portions. In both these types, the vibrating portion is primarily the head itself with the rim and other supporting hardware vibrating little if any, and thereby being considered substantially non-vibrating.

In a pre-tuned head, the head is pre-tensioned within the rim itself, thereby requiring no tensioning for tuning or the production of the desired tone. Instead of engaging lugs, the flanges cooperate with clamping members to hold the pre-tuned head to the arcuate member. This can take place either by way of a hook link member which clamps the head to the grommet with the hook passing through the grommet and terminating in the threaded end which receives a wing nut thereon. Alternatively, an extrusion-like member may be utilized formed of an elastic material having a cut-out coinciding with the cross section of the rim of the pre-tuned head with provision for engaging the aperture of the flange as well. This embodiment is easier and more inexpensive to manufacture, as well as performing its intended function efficiently. The use of such a mounting system negates the need for a shell allowing manufacture of an inexpensive compact drum set.

These and other objects and advantages of my invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
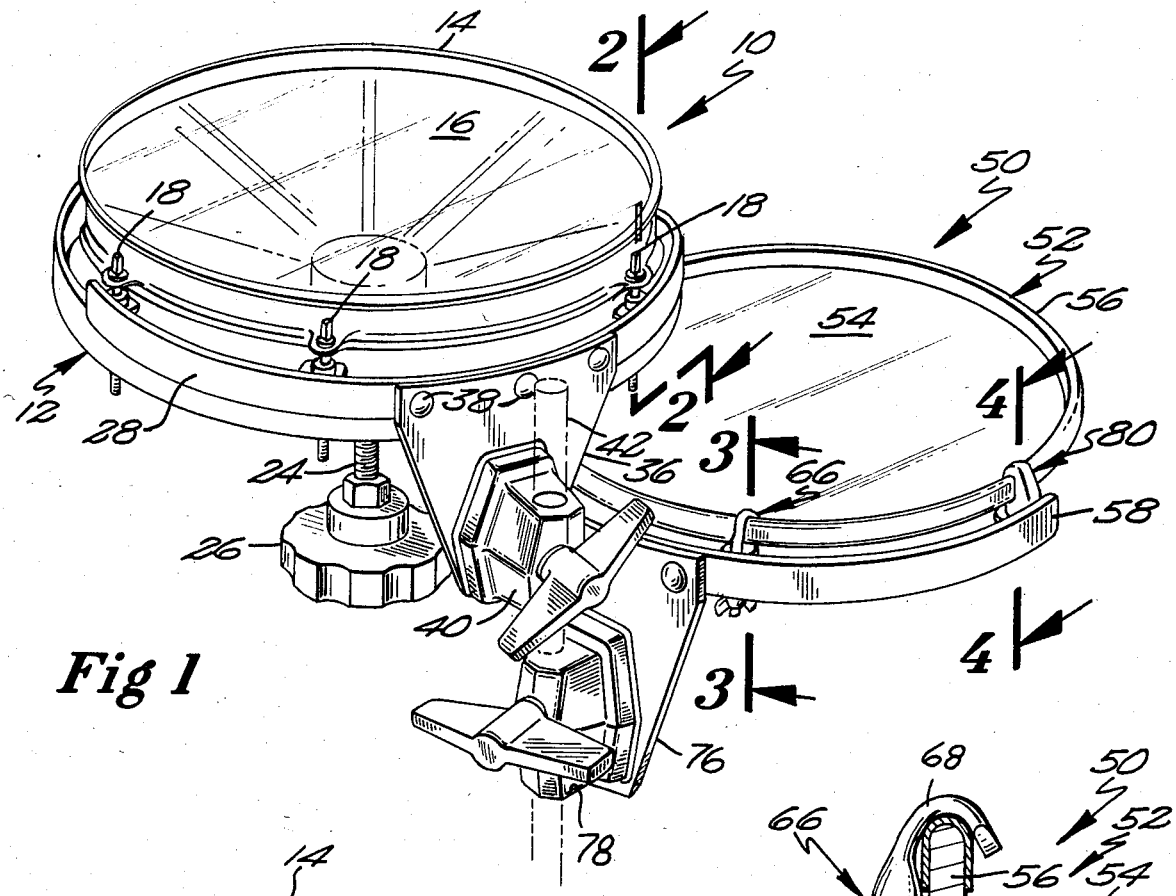
FIG. 1 is a perspective view showing the mounting bracket holding several types of shell-less drums.
Figure 2:
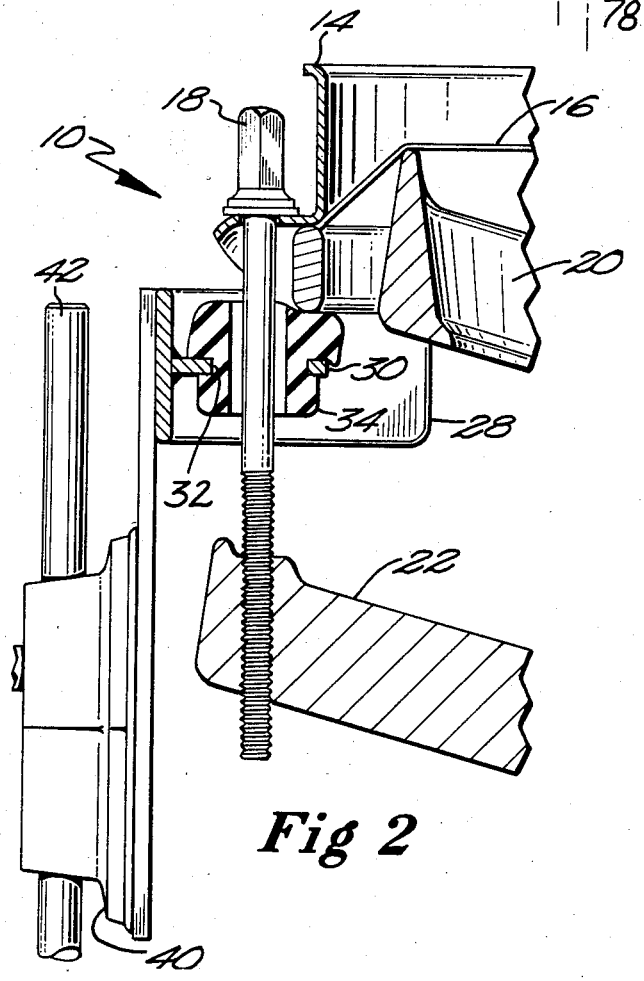
FIG. 2 is a sectional view taken along line 2—2 of FIG. 1.
Figure 3:
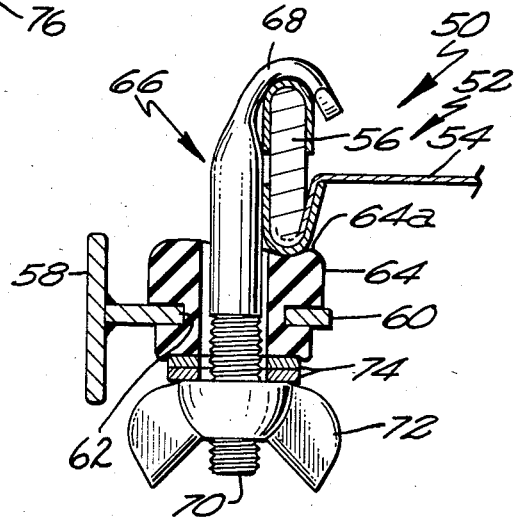
FIG. 3 is a sectional view taken along line 3—3 of FIG. 1.
Figure 4:
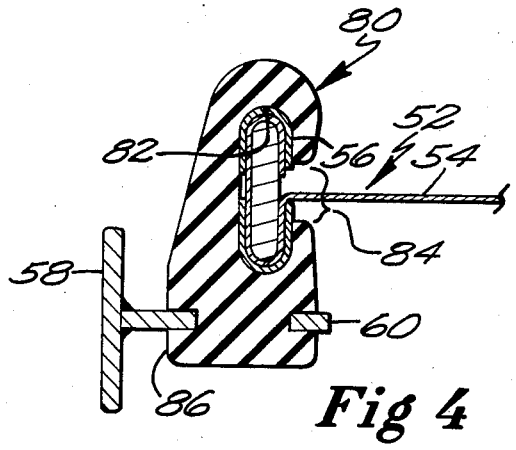
FIG. 4 is a sectional view taken along line 4—4 of FIG. 1.

The instant invention, generally designated 10, is designed for use with a shell-less drum such as roto-tom 12 shown in FIGS. 1 and 2. Roto-tom 12 is comprised of a rim 14, a head 16, lugs 18, an upper tensioning frame 20 and a lower mounting frame 22. A tensioning shaft 24 is provided having a tensioning knob 26 thereon. Drum 12 will not be shown in more detail as roto-toms of this type are well known.

An arcuate member 28 is provided which is slightly larger in diameter than drum 12 and which extends for slightly more than 180 degrees and provides substantially diametrically opposed mounting locations. Flanges 30 are located at the diametrically opposed locations and at locations intermediate the diametrically opposed locations corresponding to lug location. Radially inwardly directed flanges 30 have holes 32 therein which are circumferentially elongated to allow for slight variations in lug spacing. Grommets 34 are located in flange holes 32 and serve to isolate and dampen any minor amounts of vibration that may be present in the non-vibrating portions of the drum 12. As can be seen particularly in FIG. 1, flanges 30 and grommets 34 are located between rim 14 and lower frame 22 with lugs 18 passing therethrough.

A side plate 36 is fastened by means of conventional fasteners such as bolts 38 to arcuate member 28. A conventional drum hardware clamp 40 is fastened to side plate 36 and allows the drum 12 to be attached to conventional drum support rod 42 which is not shown in more detail due to its conventional nature.

This method of mounting serves to adapt the roto-tom to conventional drum hardware and in addition, allows the drum 12 to be easily tuned by means of knob 26 on shaft 24. Previously, tuning was accomplished by turning the whole of drum 12 due to shaft 24 being fixed relative to the drummer and its mounting on a stand.

Pre-tuned heads are a relatively recent development. By way of reference, the pre-tuned heads referred to are manufactured by Remo Incorporated and are designated PTS heads. Pre-tuned head mounting bracket 50 is designed for use with the pre-tuned head 52. Pre-tuned head 52 consists generally of a head 54 and a rim 56. An arcuate member 58 is utilized also again encircling the pre-tuned head for (in the preferred embodiment) slightly more than 180 degrees. Again, inwardly directed flanges 60 are provided with flange hole 62. Grommets 64 are inserted in holes 62 and have a top bearing surface 64*a*. Clamps 66 are inserted in hole 62 and comprise a hook portion 68 and a threaded portion 70. Hook portion 68 engages the top of rim 56 and clamps pre-tuned head 52 against bearing surface 64*a* of grommet 64. A wing nut 72 in conjunction with washer 74 assures tight clamping.

Again, a side plate 76 in conjunction with a clamp 78 is utilized to attach the arcuate member 58 to conventional drum hardware.

In an alternate embodiment, an extrusion 80 formed of a rubber or other elastic material is provided for fastening the pre-tuned head 52 to arcuate member 58. Extrusion 80 is provided with a generally C-shaped opening therein and along with a snap-in opening 84 which allows extrusion 80 to be snapped around pre-tuned head 52 for mounting. A flange portion 86 of extrusion 80 is inserted through flange hole 62 to retain head 52 to arcuate member 58.

While the preferred embodiments of the present invention have been described, it should be understood that various changes, adaptions and modifications may be made therein without departing from the spirit of the invention and the scope of the appended claims.

What is claimed is:

1. A mounting bracket in combination with a drum having a rim and a pre-tensioned head fixed in said rim, said mounting bracket comprising:

an arcuate member having a diameter slightly larger than the drum to be mounted thereto and further including means for engaging said rim at approximately diametrically opposed locations and at at least one location intermediate said opposed locations, said engaging means including at least three flanges attached to and extending radially inwardly from said arcuate member at said locations, said arcuate member being free of contact with said rim;

means for clamping said rim to said flanges including: a hole in each said flange; a plurality of hook-like members, a said hook-like member extending through each said hole and over the top of said rim; and a cushioning member intermediate the bottom of said rim and each said flange; and means for attaching said arucate member to a conventional fixed support.

2. A mounting bracket in combination with a drum having a rim and a pre-tensioned head fixed in said rim, said bracket comprising:

an arcuate member having a diameter slightly larger than said rim to be mounted thereto and further comprising means for engaging said rim at approximately diametrically opposed locations and at least one point intermediate said opposed locations, said engaging means comprising an elastic member comprising a cutout corresponding to and engaging the cross section of said rim and means for attaching said elastic member to said rim, said arcuate member being free of contact with said rim; and means for attaching said arcuate member to a conventional fixed support.

* * * * *